United States Patent [19]

Grossman

[11] 4,063,995

[45] Dec. 20, 1977

[54] FIBROUS WEBS WITH IMPROVED BONDER AND CREPING ADHESIVE

[75] Inventor: Stephen Richard Grossman, Maple Shade, N.J.

[73] Assignee: Scott Paper Company, Philadelphia, Pa.

[21] Appl. No.: 735,899

[22] Filed: Oct. 26, 1976

Related U.S. Application Data

[63] Continuation-in-part of Ser. No. 626,334, Oct. 28, 1975, abandoned, which is a continuation-in-part of Ser. No. 340,760, March 13, 1973, abandoned.

[51] Int. Cl.[2] ..... B31F 1/12

[52] U.S. Cl. ..... 162/112; 156/62.2; 156/277; 156/328; 156/332; 162/168 R; 162/175; 162/177; 162/184; 260/17.4 CL; 260/17.45 G; 260/29.6 RB; 260/29.6 WA; 427/391; 428/153; 428/211; 264/183

[58] Field of Search ..... 162/111, 112, 168 R, 162/175, 177, 184; 128/284; 156/62.2, 328, 332, 277; 260/17.4 CL, 17.4 SG, 29.6 RB, 29.6 WA; 427/391; 428/153, 211; 264/283

[56] References Cited

U.S. PATENT DOCUMENTS

| | | | |
|---|---|---|---|
| 3,316,198 | 4/1967 | Van Gorder et al. | 428/481 |
| 3,554,788 | 1/1971 | Flechillas | 128/284 |
| 3,561,447 | 2/1971 | Alexander | 156/328 |
| 3,616,166 | 10/1971 | Kelley | 260/29.6 RB |
| 3,804,092 | 4/1974 | Tunc | 128/284 |
| 3,812,000 | 5/1974 | Salvucci et al. | 162/168 R |
| 3,876,596 | 4/1975 | Grubert et al. | 260/17 R |
| 3,879,257 | 4/1975 | Gentile et al. | 162/112 |
| 3,903,342 | 9/1975 | Roberts | 162/112 |
| 3,923,592 | 12/1975 | George et al. | 162/190 |

*Primary Examiner*—Robert L. Lindsay, Jr.
*Assistant Examiner*—William F. Smith
*Attorney, Agent, or Firm*—Nicholas J. DeBenedictis; John W. Kane

[57] ABSTRACT

Creping of fibrous webs to enhance their softness and bulk is improved and the resulting creped web is made strong, water dispersible and non-blocking by employing a bonder and creping adhesive composition containing four components which are blended to produce a mixture having a percent solids of from 10% to 40% and an initial modulus for a film of the solids of less than $1.75 \times 10^8$ dynes/cm$^2$. The composition (mixture) functions as a bonder for the fibers to impart strength and as a creping adhesive for the web so that creping enhances softness and bulkiness. Also disclosed are methods of creping employing such a bonder and creping adhesive composition and sheet materials creped with such compositions.

22 Claims, No Drawings

FIBROUS WEBS WITH IMPROVED BONDER AND CREPING ADHESIVE

RELATED APPLICATIONS

This application is a continuation-in-part of U.S. application Ser. No. 626,334, filed Oct. 28, 1975 now abandoned, which is in turn a continuation-in-part of U.S. application Ser. No. 340,760, filed Mar. 13, 1973 now abandoned.

BACKGROUND OF THE INVENTION

1. Field of the Invention

This invention relates to improved fibrous sheet materials and methods for forming such materials. More particularly this invention concerns fibrous sheet materials that have been bonded, preferably pattern bonded, with a viscous bonder and adhesive composition and then creped, preferably differentially creped, from a creping surface on which the fibrous sheet material is adhered by the bonder and adhesive. Such fibrous materials have improved tensile strength, softness and bulk; are water dispersible, and are non-blocking.

2. Description of the Prior Art

In the past, there has been extensive activity in the field of papermaking to discover ways of imparting softness to paper webs without degrading their strength. Paper webs are conventionally softened by working them in different ways, such as by creping them from a surface, usually a drying surface with a creping blade. Such a process disrupts and breaks many of the inter-fiber bonds in the paper web which are formed during drying. However, these inter-fiber bonds are the principal source of strength in an ordinary paper web. Very little strength results from the physical entanglement of the fibers since papermaking fibers have an extremely short length, generally on the order of 1/16 inches or less.

The softness of creped, fibrous sheets has been increased by chemically impeding or preventing the inter-fiber bonds while the strength of the sheet has been maintained by adding bonding materials to the sheet. The chemicals which usually interfere with the inter-fiber bondings also tend to prevent proper adhesion of the fibrous sheet to the creping surface and therefore interfere with creping. To overcome this undesirable affect, creping adhesives have been added to the sheet or the creping surface to obtain proper adhesion between the fibrous sheet and the creping surface. The bonder and/or adhesive materials that are added to the sheet can be uniformly applied across the whole sheet or printed onto the sheet in a specific pattern.

In the production of soft, creped sheets for tissue products it is desirable that the chemicals added to the sheet for adhesion to the creping surface and for bonding of the fibers to strengthen the sheet be water dispersible in order that the tissue will disperse when discarded in water after use. Another requirement for creped, fibrous sheets is known as the non-blocking property. Soft, creped sheets suitable for tissues and similar products are usually rolled and it is necessary that the sheet unravel from the roll without sticking together or otherwise interfere with unraveling. Interference with unraveling when caused by the chemicals added for fiber bonding or adhesion to the creping surface is called a blocking effect. Therefore, a desirable creping adhesive and fibrous sheet bonder for use on soft tissue type products must adequately adhere the sheet to the creping surface, must provide adequate bonding strength to the fibrous sheet, must be water dispersible, must product a soft sheet and must set sufficiently in the papermaking process to be non-blocking when the sheet is rolled. All of these properties were not attainable with a single chemical.

SUMMARY OF THE INVENTION

Soft, strong, non-blocking, water dispersible fibrous sheet products are produced by creping employing a bonder and croping adhesive composition comprising a four component mixture containing (1) a water emulsion of softening compound having an initial modulus of less than $2 \times 10^7$ dynes/cm$^2$; (2) a water dispersible emulsion whose solid film has an initial modulus from $3 \times 10^7$ to $1 \times 10^8$ dynes/cm$^2$; (3) a block suppressant; and (4) a water soluble polymer. In the process of imparting strength, softness and bulkiness to fibrous webs by adding a bonder and adhesive to the formed web, and creping the web, the improvement provided by this invention comprises employing a water based bonding and adhesive composition having a solids content of from about 10% to about 40% and an initial modulus for a film of the solids of less than $1.75 \times 10^8$ dynes/cm$^2$, said solids content and modulus being obtained by admixing at least said four components within the following percentages based upon the solid content; (1) from about 15% to about 40%; (2) from about 25% to about 60%; (3) from about 10% to about 37%; and (4) from about 5% to about 12%. If necessary, viscosity adjusting compounds can be added to the bonding and adhesive mixture to obtain a viscosity suitable for a particular mode of application of the mixture to the web or creping surface.

Compounds suitable for use as component 3, the blocking suppressant, have been discovered having glass transition temperatures below +30° C and as low as 0° C. When such softer, low glass transition temperature compounds are used as component 3, then lower quantities of component 1 can be utilized in the bonder and creping adhesive composition and still obtain improved softness.

An additional class of compounds have been discovered as being suitable for component #3, which are water soluble and function as a blocking suppressant. This newly discovered class is normally solid, non-ionic, water soluble, oxygen containing organic compounds having a molecular weight of less than about 500. Preferred are water soluble sugar compounds. Such water soluble compounds do not exhibit true glass transition temperatures. Nitrogen containing compounds are not preferred because of their possible toxicity problems.

DETAILED DESCRIPTION OF THE INVENTION

The method of the present invention may be applied to a wide variety of webs in order to form the improved creped sheet materials of the present invention. This means that a wide variety of processes may be utilized to initially form such webs. For example, the webs may be formed by depositing fibers on a condensing means such as a foraminous surface from a suspension in a fluid medium, which may be either gaseous or liquid. Thus, the initial sheet may be either air-laid or wet-laid, that is formed from fibers deposited from either a gaseous suspension or a liquid suspension onto a condenser such as a Fourdrinier wire as is commonly done in papermaking. Wet-laid sheets are preferred and more preferably the sheets are dried without significant pressing and the natural fiber to fiber bonding in the formed web is impeded, usually by chemical means.

Regardless of the particular apparatus or process utilized to form the fibrous web, the web is creped according to the improved process of the present invention which transforms the web into sheet material having superior softness, strength, bulkiness and which is water dispersible and non-blocking.

In order to produce a softer, stronger and generally bulkier web that is water dispersible and non-blocking, it is preferred to employ a web which is initially relatively soft, and quite weak. All of these properties are generally possessed by a web which has low inter-fiber bonding strength such as air-laid webs or wet-laid non-wet pressed webs with chemical debonders. The method of the present invention imparts to such webs improved combination of softness, bulk and strength.

The preferred reduced inter-fiber bonding strength of wet-laid webs to be treated by the improved process of this invention can be achieved in several ways. Preferably, this reduced interfiber bonding strength in the web is obtained by treating the fiber with a chemical debonder either in the fiber furnish, prior to their addition to the fiber furnish, or even after formation of the web. Such chemical debonders are believed to function by reducing the number of sights along the individual fibers which are susceptible to natural inter-fiber bonding of the type utilized in papermaking. Debonding agents which may be used for this purpose include the cationic debonding agents disclosed in U.S. Pat. No. 3,395,708 issued Aug. 6, 1968 to Hervey et al. Examples of surfactants suitable for use as debonder agents are long chain cationic surfactants, preferably with at least 12 carbon atoms in at least one alkyl chain, such as fatty dialkyl quaternary amine salts, monofatty alkyl tertiary amine salts, primary amine salts, and unsaturated fatty alkyl amine salts; the cation-active tertiary amine oxides disclosed in U.S. Pat. No. 2,432,126; and the cation-active amino compounds disclosed in U.S. Pat. No. 2,432,127. These enumerated debonders are just a few of the many debonders known to be suitable in the papermaking art.

Suitable webs are preferably those having a basis weight of between about 5 and about 55 pounds per 2,880 square feet. Such basis weight sheet products derive the most benefit from the improved creping process of the present invention since they are largely used where softness and bulk are important, and also where strength is important.

Conventional creping processes which are improved by the present invention are well known in the art and consist of two general processes; one in which the web is adhered to a creping surface either naturally or chemically and removed with a doctor blade (creping blade), and a second in which the web travels through mating rollers rotating at different speeds. Although the adhesive qualities of the mixture employed in the present invention are not needed in the second creping method, the mixture still imparts the beneficial properties to the resulting creped web.

Preferably, the web is creped by adhering the web to a creping surface and removing the web from the surface with a doctor blade with the percent crepe being influenced by the difference in speed of the web before and after the doctor blade. Preferably, the creping surface is a heated rotating drum such as conventional equipment known as a Yankee dryer.

The bonder and creping adhesive can be applied to the creping surface itself or to the fibrous sheet by any suitable means. For example, the mixture can be applied by spraying the chemicals onto the fibrous sheet or creping surface; by printing either continuously or in a pattern (up to 60% coverage) onto the creping surface or the fibrous sheet before it contacts the creping surface. When the adhesive and bonding chemicals are printed in a pattern either onto the creping surface or onto the fibrous sheet material, it is necessary that the chemicals have a suitable viscosity so as to essentially retain the print pattern fidelity on the fibrous sheet material. Specific suitable viscosities depend upon the type of equipment used to apply the mixture, however, the mixture of the present invention have viscosities suitable for most methods of application and when necessary the viscosity of the mixtures can be adjusted with any known viscosity adjuster. Preferably the bonder and creping adhesive is printed in a continuous pattern on the sheet.

Each component in the bonder and adhesive composition contributes to one or more of the functions of the composition, namely imparting softness and strength to a fibrous web that is also water dispersible and non-blocking. Component (1) mainly contributes to the softness of the fibrous web, however, its use by itself as a bonder and creping adhesive would be inadequate since the product would either be non-water dispersible or would block. Component (2) contributes to softness of the product, however, while component (2) is generally not as effective as component (1) in contributing to softness it is not detrimental as is component (1) to the water-dispersibility of the final product, furthermore, component (2) has a blocking tendency. Component (3) is usually water insoluble and has a glass transition temperature of between 0° C and +50° C. Component (3) mainly contributes to the non-blocking quality of the resulting product but in excess will impair dispersibility and softness attributes. Component (4) is a water soluble polymer that has a viscosity of at least 100 centiposes for an 8% solution, and being water soluble contributes to the water-dispersibility of the resulting product but tends to impair softness.

It has been discovered that by applying from 1% to 5% of a mixture of the four components based upon the weight of solids in the mixture and bone dry weight of the web, a superior product is obtained with regards to softness, strength and bulkiness, which product is also water dispersible and non-blocking. The relative quantities of the four components in the mixture can vary within the percentage ranges given above. As long as the components are within the specified ranges, the resulting mixture is suitable for use as a bonder and creping adhesive to produce soft, bulky, fibrous webs that are water dispersible and non-blocking.

Each component in the mixture contributes to one or more of the desired product properties and also has detrimental effects upon other desired product properties. In order to obtain the desired properties in the fibrous sheet material of strength, softness, bulkiness and have a product that is water dispersible and non-blocking, it has been discovered that each of the components in the mixture can be blended so that their contribution to desired product properties is retained and imparted to the fibrous sheet materials while their undesirable properties are more than off-set by each other.

Specifically, component (1) contributes mainly to softness but tends to have a detrimental effect upon water-dispersibility and sometimes inhibits unraveling of the rolled fibrous sheet material (blocking). Likewise component (2) while contributing to softness is not detrimental to the water-dispersibility of the resulting sheet but also has a blocking tendency. Therefore, the relative amount of components (1) and (2), added for fiber bonding and sheet softness affects the amount of component (3) needed to off-set the blocking characteristics of 1 and 2. While component (3) overcomes the blocking difficulties of components (1) and (2), it tends to impart dispersibility problems to the product which must be overcome by component (4). Therefore the relative amounts of (1) and (2) affect the amount of (3) while the total of (1), (2) and (3) affects the amount of (4) needed for $H_2O$ dispersibility. So long as the relative amounts of components (1), (2), (3) and (4) are within the percentage ranges specified above, the resulting bonder and creping adhesive composition will produce a fibrous sheet material having the desired properties. However, it is preferred to select the percentages of components (1) and (2) at values close to the mid-point of their respective percentage ranges so that the amount of component (3) needed to impart non-blocking characteristics is closer to the lower end of its percentage range and therefore the amount of component (4) needed to impart water-dispersibility will also be closer to the lower end of its percentage range. Such preferred mixtures tend to maximize the softness, strength and bulkiness of the desired product while retaining water-dispersibility and non-blocking characteristics.

Component (1) is a fiber bonder (softening compound) which enhances the softness of the fibrous sheet after creping. Any of the many known polymers for bonding fibers in nonwoven webs or sheets is suitable for blending as component (1) providing the polymer is capable of forming an emulsion in water either with or without normal emulsifiers and a film of the polymer solids has an initial modulus of less than $2 \times 10^7$ dynes/cm$^2$. The initial modulus referred to herein for component (1), for the mixture, and for other components is an initial modulus at 1% elongation for film of the solids being tested according to ASTM test D638. Examples of suitable known emulsion polymers which function as bonders for fibers especially cellulosic fibers in nonwoven webs are acrylates; styrene-butadienes; polybutadienes; acrylonitriles; acrylonitrile-butadienes; polyurethans; ethylene vinyl acetates; polyvinyl alkyl ethers; polyacetals; polyterpenes; vinyl acrylics; ethylene-vinyl acrylates; polychloroprenes; polychlorohydrins; acrylate-acetate copolymers; plasticized polyvinyl chlorides and plasticized polyvinyl acetates.

Component (2) of the mixture is an emulsion of a water dispersible polymer-hydrocolloid system whose film has an initial modulus of from $3 \times 10^7$ to $1 \times 10^8$ dynes/cm$^2$ and which will function as a bonder for fibers, especially cellulosic fibers in nonwoven webs. An example of such a bonder is a non-cross linking copolymer of vinyl acetate and acrylic esters. The copolymer is emulsified and stabilized with a non-ionic hydrocolloid in the ratio of about 3 parts by weight copolymer to about 1 part by weight hydrocolloid. The resulting copolymer-hydrocolloid has large particle size (one micron average) relative to other emulsion copolymer systems made using similar methods. The presence of the hydrocolloid molecules which tend to be electrochemically attached to the copolymer results in a dried film obtained from the emulsion that is water redispersible when recontacted with water and thereby tends to reemulsify. Hydrocolloids are well known and are water soluble polymers that function as protectors in the formation of an emulsion of a non-water soluble polymer. Typical known hydrocolloids are hydroxyethyl cellulose, methylcellulose, alginates and polyvinyl alcohols. As example of a non-water dispersible polymer that has been combined with a hydrocolloid and emulsified to result in a water dispersible colloidal emulsion, the solid components of which produces a dried film that is redispersible in water is a composition available from National Starch Corporation known as 78-5329®. Such a water dispersible bonder has an initial modulus of $5 \times 10^7$ dyne/cm$^2$ and a glass transition temperature of $-46°$ C.

Component (3) can be any of the known polymers suitable for use as a bonder for fibers, particularly cellulosic fibers in non-woven webs provided it has a glass transition temperature of from about $+30°$ C to about $+50°$ C so that it will function as a blocking suppressant. Such polymers are normally non-water soluble and therefore applied to the web in the form of the water emulsion of the polymer. Examples of such polymers applied as emulsions are polyvinyl chloride, polyvinyl acetate, polystyrene and acrylates. Some water soluble polymers have the required glass transition temperatures and are therefore suitable for use as component (3). Examples of such water soluble polymers are polyvinylpyrollidones low molecular weight, partially hydrolyzed polyvinyl alcohols and ethers such as polyvinyl methyl ether.

Furthermore, polymers have been discovered having glass transition temperatures lower than $+30°$ C and which are also capable of functioning as a bonder for fibers. Polymers having a glass transition temperature as low as about 0° C, have been found suitable and since such polymers are softer they permit the use of lower quantities of component 1. Accordingly, the operable range for component 1 can be extended down to from about 8% to about 15% when used in combination with adhesive polymers having a glass transition temperature of from about 0° C to about $+30°$ C.

Examples of adhesive polymers having a glass transition temperature from about 0° C to about $+30$ ° C and therefore suitable for use as component 3 include ethylene vinyl acetate, polyvinyl acetate and the like. In addition those possessing ordinary skill in the adhesive polymer art could readily select or make adhesive polymers having the necessary glass transition temperature from such polymers as styrene butadiene copolymers, acrylic acetate copolymers, and similar emulsifiable polymers that combine both hard and soft monomers.

Commercially available adhesive polymers having suitable glass transition temperatures include ELVACE® 1961 (Tg=20° C) sold by DuPont Chemical Company as a 50% solids emulsion having a viscosity of 300 centipoise (#3 spindle at 60 RPM). ELVACE® 1961 is a thermoplastic non-crosslinking acetate-ethylene copolymer having modulus of 4,600 psi, a tensile of 1,700 psi, a percent elongation of 500 and a pH of 6.

An additional class of water soluble, normally solid, nonionic, oxygen containing organic compound have been discovered as being suitable for use as Component (3). A lower limit for the percentage range for component (1) can be used with the "water soluble" compounds so that from 8 to 40% of component (1) can be used when component (3) is selected from the water soluble class or the class having a lower glass transition temperature of from 0° C to +30° C. A further advantage associated with the use of the water soluble class for component (3) is that the water soluble class does not interfere with water dispersibility but enhances the water dispersibility of the system. By "water soluble" is meant a water solubility of greater than 10% by weight at 20° C. By "normally solid" is meant a solid at 25° C and 760 mm Hg pressure.

Typical examples of normally solid, non-ionic, water soluble, oxygen containing organic compounds are sugars such as sucrose, arabinose, cellobiose, fructose, dextrose, glucose, glucoside, D-lyxose, maltose, D-mannitol, D-sorbose, D-threose and the like.

Component (4) can be any of the many known water soluble polymers suitable for use as fiber bonders especially cellulosic fibers in nonwoven webs provided the polymer is sufficiently soluble to form an 8% by weight water solution and has a viscosity for such an 8% water solution of at least 100 centipoise. Examples of such known water soluble bonders are partially hydrolyzed polyvinyl alcohol; alkali metal (sodium) carboxymethylcellulose; hydroxyethylcellulose; polyacrylic acid salts; alginates; Casein (protein); gelatin; cellulose ether; polyacrylamide; dextrins and soluble starch type products; gums (arabic, karaya, etc.); polyvinyl methyl ether; carboxyvinyl polymers; polyethylene oxide; polyethyleneimine; polyvinylpyrollidone; methylcellulose; ethyl methylcellulose; sodium cellulose sulfate; hydroxypropyl methylcellulose; and polyethylene glycol.

Polyvinyl methyl ethers and polyvinylpyrollidones have been discovered to be suitable both as a selection for component (4) and as a selection for component (3). However, when either of these two compounds are selected as both component (3) and component (4), the required percentage should be from 15 to 49% of the mixture.

In order to obtain improved softness, it has been discovered that a dried film of the active components must have a modulus of less than $1.75 \times 10^8$ dynes/cm$^2$.

The following examples demonstrate that when four components having the properties specified above are blended within the percentage ranges specified above and applied to a fibrous sheet material which is subsequently creped results in the production of a soft, strong, bulky product that is water dispersible and nonblocking. Examples 1, 2, 5, 6, 9, 10, 13 and 14 are outside the required percentage range for a component either high or low as indicated by a + or − respectively. As indicated by the examples, the lower the modulus for the mixture, the superior the softness of the product.

EXAMPLES I–XVI

A roll of flat cellulosic sheet material having its natural fiber to fiber bonding tendency decrease by incorporation of a debonder and produced by a non-wet pressing and transpiration drying was employed in all of the examples. The cellulosic sheet material had a machine-direction tensile (MDT) of 20 to 35, a cross-machine directions tensile (CDT) of 5 to 11; a machine direction stretch (MDST) and a cross-machine direction stretch (CDST) of 2 to 3%. In each of the examples a bonder and adhesive composition was blended from individual bonders and adhesive chemicals in the percentage ranges indicated in the second column of the table. The resulting mixture had a percent solids indicated in column 7 and a film of the solids had an initial modulus at 1% elongation as determined according to ASTM test D638 as indicated in column 3. Component 1 of the mixture used in examples I–XVI is a copolymer of acrylic esters comparable to a copolymer of butyl acrylate and ethylhexyl acrylate having a modulus of $7 \times 10^6$ dynes/cm$^2$. Specifically, the acrylic ester copolymer was a water emulsion available from Rohm & Haas under the trade name HA-8 ® and had a glass transition temperature of −13° C. Component (2) a hydrocolloidally dispersed polymer of the mixture. This component is a water emulsion in which about 75% of the solids are a non-cross linking copolymer of vinyl acetate and acrylic esters and 25% of the solids in the water emulsion are hydrocolloids that will redisperse the vinyl acetate-acrylic ester copolymers after they are dried in a film. This hydrocolloidally dispersed component has a glass transition temperature of −46° C and an initial modulus of $5 \times 10^7$ dynes/cm$^2$ and a particle size of about one micron. Such a hydrocolloidally dispersed polymer is available from National Starch under the trade name 78-5329 ®. Component (3) is an anionic emulsion of a cross-linking polyvinyl acetate copolymer having a pH of about 4 to 5, a non-volatile solids content of 45 to 47% and a density of 9.05 to 9.15 pounds per gallon. Such polyvinyl acetate emulsion copolymers are available from Celanese Corporation under the trade name POLY TEX 6330 ®. Component (4) is a sodium salt of carboxymethylcellulose having a viscosity greater than 100 centipoises for an 8% solution. Such sodium carboxymethylcellulose compounds are available from Hercules Chemical Company under the trade names CMC12M8 and 7L1.

The bonder and adhesive compositions shown in the table were printed onto the fibrous sheet in a diamond pattern with a width of 104 mils in the cross-machine direction, a height of 52 mils in the machine direction, and 8 mils between adjacent sides of repeating diamond patterns. The resulting print bonded web was creped at 100 feet per minute from a creping surface at 15% crepe. The creping surface consisted of a laboratory size Yankee dryer heated to about 110° C. The resulting differentially creped web had a bulk machine direction tensile (MDT); a cross-machine direction tensile (CDT); a machine-direction stretch (MDST); a cross-machine direction stretch (CDST); a flushability index; a blocking index; and a softness characteristic as determined by hand feel as reported in the table.

The mixture used in each example had a viscosity as indicated in column 6 in the table. The basis weight of the fibrous material before creping varied slightly despite the fact that the web being creped in all the examples was obtained from the same roll of material. This variation is within normal limits for a commercially produced fibrous web and does not affect the validity of the tests. The basis weight is indicated in column 4 of the table.

The resulting product was tested for flushability according to the following procedure; two liters of cold tap water is placed in a four liter beaker that contains a 2 inches magnetic stirring bar which is rotated at a rate of 500 rpm. The bar is rotated for 15 to 30 seconds until maximum stirring is achieved, then the paper sample being tested is folded into quarters and dropped into the beaker. The time that the paper takes to completely segment into small pieces with agitation is recorded. Anything requiring less than 300 seconds to break apart is deemed flushable (water dispersible). The results for each example is reported in the table under the column headed flushability.

The blocking characteristic of the resulting web product was determined according to ASTM test number D918-49 by placing sheet samples in a Pasadena Hydraulic Press and subsequently using an Instron instrument to measure the peel strength of the sheets. The products were then rated on a scale of 1 to 10 based upon the amount of force registered on the Instron, with those samples having a value of 5 or greater considered unacceptable for blocking. The Instron values are correlateable with the force required to unravel a roll of the product. The exact force required to unravel the roll is not particularly meaningful since the specific strength which is acceptable in terms of blocking varies depending upon the basis weight and strength of the tissue being tested. However, the relative propensity of a bonder and adhesive composition to cause blocking is meaningful and independent of the strength of the specific fibrous web sheet being employed. Therefore, the relative scale of 1 to 10 is used and reported rather than specific force numbers required for unraveling the roll.

The product produced from each of the examples was tested by a panel of experts for softness according to the hand feel of the resulting product. Softness and hand feel being a subjective measurement is impossible to determine precisely in quantitative terms. A relative scale was assigned to the products of each example with those examples having a softness considered about comparable to the softer commercially available tissue products being assigned a rating of "average". Those products having improved softness over the softer commercial products were assigned a value of "improved". Those products that attained the most significant improvement in softness were rated "superior". The softness results are generally correlateable with the modulus of a film of the active components (solids) in the mixture being tested. This is, those mixtures having a modulus of less than $1.75 \times 10^8$ result in improved softness over generally available commercial products with the lower the modulus, the better the softness.

All proportions used herein are based upon weight unless indicated otherwise. Percentages of the components are based upon the solids in each component in relation to the total solids content of the mixture.

EXAMPLES 17, 18, 19

The procedures of Examples 1 to 16 were repeated. For each example, the Supplemental Table indicates relative quantities of each component employed in the overall bonder and creping adhesive along with the initial modulus, viscosity, and precent solids of the resulting bonder and creped adhesive. In addition, the basis weight, bulk of the paper and the percent solids added onto the paper are given in the Supplementary Table along with properties for tissue creped with the bonder and creping adhesive. As can be seen from the Supplementary Table, when a blocking suppressant (component 3) having a glass transition temperature of from about 0° to about 30° C is employed (Examples 17 and 18), the quantity of component 1 which contributes primarily to softness can be reduced to the range of from about 8% to about 15%. The lower glass transition temperature for component 3 indicates that component 3 is softer and accordingly a lower quantity of the adhesive selected for its softness properties (component 1) can be employed in the overall composition and still obtain superior hand feel. However, even with component 3 having low glass transition temperatures, very low levels for component 1 still result in unacceptable hand feel (average hand feel value for Example 18 as compared with the improved value for Examples 17).

In Examples 17, 18 and 19, component 1 was a mixture of equal parts by weight of HA8 ® (the same component 1 employed in Examples 1 to 16) and, Ubatol U-3610 ® an acrylic carboxylated copolymer emulsion having an initial modulus for film of a solid of $1 \times 10^7$ dynes per square centimeter, a solids content of 34% to 36% of about 7.4 and a density of 8.7 pounds per gallon. Component 2 is NACRYLIC 4442 ® (formerly 78-5420) available from National Starch and Chemical Corporation, Bridgewater, N.J. as a hydrocolloidally dispersed acrylic acetate copolymer having 37% to 39% solids, pH of about 5, a viscosity of 700 to 1,500 cps (Brookfield), an average particle size of about 1.0 Micron, a density of about 1.02 grams per cc (latex density at 72° F) and anionically emulsified. The film properties of NACRYLIC 4442 ® are film hardness of 2 SRH (Sward Rocker Hardness at 72° F or 1.5 mil for wet, forced dried films cast on plate glass) slightly hazy, flexible, water redispersable, and having an initial modulus of $5 \times 10^7$ dynes per square centimeter; component 3 was Elvace ® 1961 (previously defined) in Examples 17 and 18 while in Example 19 component 3 was 40-10 TM a partially hydrolyzed, low molecular weight polyvinyl alcohol available from Monsanto Chemical Company and having a glass transition temperature of about +50° C; component 4 was carboxymethylcellulose of the type employed as component 4 in Examples 1 to 16.

The characteristics of the resulting bonder and creping adhesive and the properties of a web creped with such an adhesive are given in the Supplemental Table.

EXAMPLE 20

The procedure used in examples 1–19 was repeated employing percentages of components indicated in Table 2. Component 1 was an ethylene vinyl acetate co-polymer (film initial modulus of $<2 \times 10^7$). As Component 2, two hydrocolloidally dispersed, acrylic-vinyl acetate co-polymers were used which are available from National Starch as NACRYLIC ® 4442 and 78-5472. NACRYLIC ® 78-5472 has chemical and physical properties similar to NACRYLIC ® 4442 for the purpose of this invention. Sucrose was used as Component #3. A carboxy-methyl-cellulose was used as Component #4 (12M8 available from Hercules and defined supra). The resulting properties of the binder and adhesive fluid are given in Table 2, along with the properties of tissue produced with the fluid.

Example 20 demonstrates that the range for Component 2 can be increased to 65% when Component 3 is selected from the newly discovered water soluble class.

TABLE 2

| Components | | | | | | | | | Solids |
|---|---|---|---|---|---|---|---|---|---|
| 1 | 2 | 3 | 4 | Modulus | BW | Bulk | Visc. | Solids | Add-on |
| 8.4 | 64.6 | 20 | 7 | $1.6 \times 10^8$ | 16.7 | 236 | 475 | 20.2 | 3.4 |
| MDT | CDT | MDST | CDST | | Flush-ability | | Blocking | | Handfeel |
| 14.5 | 4.5 | 17.0 | 9.5 | | 50 | | 4.5 | | Improved |

TABLE

| EX. | COMPONENTS-% 1 | 2 | 3 | 4 | MODULUS | B.W. | BULK | VIS-cosity | SOLIDS % | SOLIDS ADD-ON |
|---|---|---|---|---|---|---|---|---|---|---|
| 1− | 10− | 50 | 30 | 10 | [$3.3 \times 10^8$] | 16.2 | 234 | 530 | 18 | 3.3 |
| 2+ | 50+ | 28 | 15 | 7 | $2.65 \times 10^7$ | 16.8 | 234 | 360 | 22 | 4.7 |
| 3 | 20 | 40 | 30 | 10 | $9.55 \times 10^7$ | 16.5 | 234 | 550 | 18 | 2.6 |
| 4 | 35 | 30 | 25 | 10 | $3.54 \times 10^7$ | 16.7 | 234 | 570 | 18.4 | 1.9 |
| 5− | 37 | 20− | 34 | 9 | $7.6 \times 10^7$ | 16.5 | 225 | 495 | 14 | 2.1 |
| 6+ | 17 | 65+ | 12 | 6 | $2.52 \times 10^7$ | 16.5 | 234 | 370 | 23 | 2.9 |
| 7 | 35 | 30 | 26 | 9 | $1.0 \times 10^8$ | 16.5 | 234 | 480 | 14.3 | 2.2 |
| 8 | 25 | 55 | 13 | 7 | $3.5 \times 10^7$ | 16.6 | 249 | 400 | 21 | 3.4 |
| 9− | 35 | 50 | 5− | 10 | $7.1 \times 10^7$ | 16.4 | 234 | 375 | 18.1 | 2.9 |
| 10+ | 20 | 30 | 40+ | 10 | [$2.05 \times 10^8$] | 17.0 | 240 | 575 | 18.4 | 2.7 |
| 11 | 31 | 45 | 15 | 9 | $7.2 \times 10^7$ | 16.3 | 234 | 500 | 16.3 | 2.5 |
| 12 | 22 | 35 | 35 | 8 | $1.4 \times 10^8$ | 16.3 | 234 | 550 | 16.6 | 2.4 |
| 13− | 35 | 33 | 30 | 2− | $2.0 \times 10^7$ | 17.1 | 244 | 400 | 24.1 | 4.6 |
| 14+ | 30 | 35 | 20 | 15+ | [$3.7 \times 10^8$] | 16.5 | 240 | 490 | 22 | 3.6 |
| 15 | 24 | 50 | 20 | 6 | $4.3 \times 10^7$ | 16.9 | 240 | 410 | 20 | 3.3 |
| 16 | 30 | 35 | 25 | 10 | $1.3 \times 10^8$ | 16.1 | 234 | 340 | 14.3 | 2.4 |

| EX. | MDT | CDT | MDST | CDST | FLUSH-ABILITY | BLOCKING | HAND FEEL |
|---|---|---|---|---|---|---|---|
| 1− | 13.5 | 4.6 | 18% | 7% | 80 | 2.5 | Average |
| 2+ | 15 | 4.5 | 16 | 9.0 | [400] | [9.0] | Superior |
| 3 | 16 | 4.0 | 17 | 8.0 | 120 | 3.0 | Improved |
| 4 | 16 | 4.3 | 18 | 9.4 | 250 | 4.5 | Superior |
| 5− | 15 | 4.3 | 16 | 7.0 | [470] | 3.3 | Improved |
| 6+ | 15 | 4.2 | 17 | 7.0 | 50 | [7] | Superior |
| 7 | 14 | 4.1 | 16 | 8.0 | 80 | 3.0 | Improved |
| 8 | 15 | 4.6 | 15.0 | 6.5 | 120 | 4.5 | Superior |
| 9− | 15 | 4.4 | 18 | 8.4 | 130 | [6] | Improved |
| 10+ | 14 | 4.5 | 19 | 9.0 | [450] | 2.6 | Average |
| 11 | 14 | 4.4 | 20 | 6.0 | 110 | 4.6 | Improved |
| 12 | 16 | 4.4 | 18 | 5.0 | 55 | 2.6 | Improved |
| 13− | 17 | 5.0 | 17 | 9.0 | [700] | [5.2] | Superior |
| 14+ | 14 | 5.7 | 18 | 6.5 | 40 | 2.0 | Average |
| 15 | 13 | 4.7 | 16.0 | 7.0 | 200 | 4.5 | Superior |
| 16 | 13 | 4.7 | 16.0 | 5.0 | 100 | 2.7 | Improved |

−Outside required percentage range (low)
+Outside required percentage range (high)

SUPPLEMENTAL TABLE

| Ex. # | Components % 1 | 2 | 3 | 4 | Modulus | B.W. | Bulk | Vis-cos-ity | Sol-ids % | Solids Add-On | MDT | CDT | MDST | CDST | Flush-ability | Block-ing | Hand Feel |
|---|---|---|---|---|---|---|---|---|---|---|---|---|---|---|---|---|---|
| 17 | 10 | 50 | 33 | 7 | $1.8 \times 10^8$ | 17.1 | 225 | 425 | 4.7 | 3.5 | 14.8 | 4.7 | 19 | 8 | 120 | 4.5 | Im-proved |
| 18 | 6− | 50 | 37 | 7 | $2.2 \times 10^8$ | 16.8 | 212 | 400 | 4.6 | 3.3 | 14.3 | 4.6 | 18 | 9 | 170 | 4.0 | Ave. |
| 19 | 10 | 50 | 33 | 7 | $4.0 \times 10^8$ | 17.2 | 220 | 440 | 4.6 | 3.6 | 13.9 | 4.0 | 18 | 9 | 65 | 3.0 | Ave. |

I claim:

1. In the process of imparting strength, softness and bulkiness to water dispersible fibrous webs by applying a bonder and adhesive composition to the formed web and creping the web, the improvement which comprises employing as the bonder and adhesive composition a water based composition having a solids content of from about 10% to about 40% and an initial modulus for a film of the solids of less than $1.75 \times 10^8$ dynes/cm$^2$, said solids content and modulus being obtained by admixing the following components:

1. from 8% to 40% of a water emulsion of a softening compound suitable for use as a fiber bonder whose solid film has an initial modulus of less than $2 \times 10^7$ dynes/cm$^2$;
2. from 25% to 60% of a water dispersibility imparting emulsion whose solid film has an initial modulus of from $3 \times 10^7$ to $1 \times 10^8$ dynes/cm$^2$;
3. from 10% to 37% of a blocking supressant having a glass transition temperature of from about 0° C to about +50° C; and
4. from 5% to 12% of a water soluble polymer suitable for use as a fiber bonder and having a viscosity of at least 100 centipoise for an 8% by weight water solution of the polymer.

2. The method of claim 1 in which the amount of the bonder and creping adhesive composition applied to the fibrous web is from 1% to 5% by weight based upon the weight of binder solids in the adhesive mixture and based upon the bone dry weight of the web.

3. The method of claim 2 in which the bonder and adhesive composition is printed onto the fibrous web in a continuous pattern and then creped.

4. The method of claim 2 in which component (1) is a copolymer of acrylic esters; component (2) is a hydrocolloidally dispersed copolymer of vinyl acetate and acrylic esters; component (3) is a non-ionic emulsion of a cross-linking polyvinyl acetate copolymer; and component (4) is a sodium salt of carboxy methyl cellulose.

5. The method of claim 2 in which the fibrous web is a wet-laid, non-wet pressed, transpiration dried sheet and the bonder and adhesive composition is printed onto the sheet in a continuous pattern and then creped.

6. The method of claim 2 in which the bonder and adhesive composition is applied directly to the creping surface.

7. The soft, strong, bulky water-dispersible and non-blocking fibrous web produced according to the method of claim 1.

8. The soft, strong, bulky water-dispersible and non-blocking fibrous web produced according to the method of claim 3.

9. The soft, strong, bulky water-dispersible and non-blocking fibrous web produced according to the method of claim 4.

10. The soft, strong, bulky water-dispersible non-blocking fibrous web produced according to the method of claim 5.

11. In the process of imparting strength, softness and bulkiness to water dispersible fibrous webs by applying a bonder and adhesive composition to the formed web and creping the web, the improvement which comprises employing as the bonder and adhesive composition a water based composition having a solids content of from about 10% to about 40% and an initial modulus for a film of the solids of less than $1.75 \times 10^8$ dynes/cm$^2$, said solids content and modulus being obtained by admixing the following components:

1. from 8% to 40% of a water emulsion of a softening compound suitable for use as a fiber bonder whose solid film has an initial modulus of less than $2 \times 10^7$ dynes/cm$^2$;
2. from 25% to 65% of a water dispersibility imparting emulsion whose solid film has an initial modulus of from $3 \times 10^7$ to $1 \times 10^8$ dynes/cm$^2$;
3. from 10% to 37% of a normally solid, non-ionic, water soluble, oxygen containing, organic blocking suppressant; and
4. from 5% to 12% of a water soluble polymer suitable for use as a fiber bonder and having a viscosity of at least 100 centipoise for an 8% by weight water solution of the polymer.

12. The method of claim 11 in which the amount of the bonder and creping adhesive composition applied to the fibrous web is from 1% to 5% by weight based upon the weight of adhesive solids and based upon the bone dry weight of the web and the fibrous web is a chemically debonded web.

13. The method of claim 12 in which the bonder and adhesive composition is printed onto the fibrous web in a continuous pattern and then creped.

14. The method of claim 12 in which component (1) is a copolymer of acrylic esters; component (2) is a hydrocolloidally dispersed copolymer of vinyl acetate and acrylic esters; component (3) is a sugar; and component (4) is a sodium salt of carboxy methyl cellulose.

15. The method of claim 11 in which the fibrous web is a wet-laid, non-wet pressed, transpiration dried sheet and the bonder and adhesive composition is printed onto the sheet in a continuous pattern and then creped.

16. The method of claim 11 in which the bonder and adhesive composition is applied directly to the creping surface.

17. The soft, strong, bulky water-dispersible and non-blocking fibrous web produced according to the method of claim 11.

18. The soft, strong, bulky water-dispersible and non-blocking fibrous web produced according to the method of claim 13.

19. The soft, strong, bulky water-dispersible and non-blocking fibrous web produced according to the method of claim 14.

20. The soft, strong, bulky water-dispersible non-blocking fibrous web produced according to the method of claim 15.

21. A water based bonder and creping adhesive comprising a composition having a solids content of from about 10% to about 40% and an initial modulus for a film of the solids of less than $1.75 \times 10^8$ dynes/cm$^2$, said solids content and modulus being obtained by admixing the following components:

1. from 8% to 40% of a water emulsion of a softening compound suitable for use as a fiber bonder whose solid film has an initial modulus of less than $2 \times 10^7$ dynes/cm$^2$;

(2) from 25% to 60% of a water dispersibility imparting emulsion whose solids film has an initial modulus of from $3 \times 10^7$ to $1 \times 10^8$ dynes/cm$^2$;

3. from 10% to 37% of a blocking suppressant having a glass transition temperature of from about 0° C to about +50° C; and
4. from 5% to 12% of a water soluble polymer suitable for use as a fiber bonder and having a viscosity of at least 100 centipoise for an 8% by weight water solution of the polymer.

22. A water based bonder and creping adhesive comprising a composition having a solids content of from about 10% to about 40% of an initial modulus for a film of the solids of less than $1.75 \times 10^8$ dynes/cm$^2$, said solids content and modulus being obtained by admixing the following components:

1. from 8% to 15% of a water emulsion of a softening compound suitable for use as a fiber bonder whose solids film has an initial modulus of less than $2 \times 10^7$ dynes/cm$^2$;
2. from 25% to 65% of a water dispersibility imparting emulsion whose solids film has an initial modulus of from $3 \times 10^7$ to $1 \times 10^8$ dynes/cm$^2$;
3. from 10% to 37% of a normally solid, non-ionic, water soluble, oxygen containing organic blocking suppressant; and
4. from 5% to 12% of a water soluble polymer suitable for use as a fiber bonder and having a viscosity of at least 100 centipoise for an 8% by weight water solution of the polymer.

* * * * *